US007384691B2

(12) United States Patent
Twomey et al.

(10) Patent No.: US 7,384,691 B2
(45) Date of Patent: Jun. 10, 2008

(54) DRAWN GEL-SPUN POLYETHYLENE YARNS

(75) Inventors: Conor Twomey, Dungarvan (IE); Thomas Y Tam, Richmond, VA (US); Ronald A. Moore, Midlothian, VA (US)

(73) Assignee: Honeywell International Inc, Morristown, NJ (US)

( * ) Notice: Subject to any disclaimer, the term of this patent is extended or adjusted under 35 U.S.C. 154(b) by 0 days.

(21) Appl. No.: 11/601,031

(22) Filed: Nov. 17, 2006

(65) Prior Publication Data

US 2007/0122618 A1 May 31, 2007

Related U.S. Application Data

(62) Division of application No. 11/206,838, filed on Aug. 19, 2005, now Pat. No. 7,223,470.

(51) Int. Cl.
*D02G 3/00* (2006.01)

(52) U.S. Cl. ..... 428/364; 428/394

(58) Field of Classification Search ..... 428/364, 428/394

See application file for complete search history.

(56) References Cited

U.S. PATENT DOCUMENTS

| | | | | |
|---|---|---|---|---|
| 4,551,296 | A | 11/1985 | Kavesh et al. | 264/177 |
| 4,663,101 | A | 5/1987 | Kavesh et al. | 264/178 |
| 5,443,904 | A | 8/1995 | Ohta et al. | 428/364 |
| 5,741,451 | A | 4/1998 | Dunbar et al. | 264/103 |
| 6,146,597 | A | 11/2000 | Nishida et al. | 422/147 |
| 6,448,359 | B1 | 9/2002 | Kavesh | 526/352 |
| 6,746,975 | B2 | 6/2004 | Kavesh | 442/135 |
| 6,764,764 | B1 | 7/2004 | Tam et al. | 428/375 |
| 6,846,758 | B2 | 1/2005 | Bhatnagar et al. | 442/135 |
| 6,969,533 | B1 | 11/2005 | Tam et al. | 428/364 |
| 6,979,660 | B2 | 12/2005 | Tam et al. | 442/108 |
| 2005/0093200 | A1 | 5/2005 | Tam et al. | 264/211.14 |

OTHER PUBLICATIONS

K.P. Menard, "Dynamic Mechanical Analysis", Encyclopedia of Polymer Science and Technology, vol. 9. p. 563-589, John Wiley & Sons. Hoboken, NJ, 2004.

Khanna et al., "Dynamic Mechanical Relaxations in Polyethylene", *Macromolecules*, 18, 1302-1309 (1985).

K.M. Sinnott, "Mechanical Relaxations in Single Crytals of Polyethylene", *J. Appl. Phys.*, 37, 3385 (1966).

R.H. Boyd, "Relaxation Processes in Crystalline Polymers: Experimental Behaviour—A Review", *Polymer*, 26, 323-347 (1985).

Roy et al., "Mechanical Relaxations of Oriented Gelation-Crystallized Polyethylene Films", Macromolecules, 21(6), 1741-1746 (1988).

*Primary Examiner*—N. Edwards
(74) *Attorney, Agent, or Firm*—Bruce Bradford

(57) ABSTRACT

Drawn multi-filament polyethylene yarns and articles thereof having unique signatures in dynamic mechanical analysis reflective of unique microstructures, and having superior ballistic resistant properties.

6 Claims, 8 Drawing Sheets

DRAWN GEL-SPUN POLYETHYLENE YARNS

CROSS-REFERENCE TO RELATED APPLICATIONS

This application is a divisional of application Ser. No. 11/206,838 filed Aug. 19, 2005 now U.S. Pat. No. 7,223,470 (allowed).

BACKGROUND OF THE INVENTION

1. Field of the Invention

This invention relates to drawn polyethylene multi-filament yarns and articles constructed therefrom. The drawn yarns and articles are useful in applications requiring impact absorption and ballistic resistance, such as body armor, helmets, breast plates, helicopter seats, spall shields; composite sports equipment such as kayaks, canoes, bicycles and boats: and in fishing line, sails, ropes, sutures and fabrics.

2. Description of the Related Art

Multi-filament "gel spun" ultra-high molecular weight polyethylene (UHMWPE) yarns are produced by a number of companies, including Honeywell International Inc., DSM N.V., Toyobo Co., Ltd., Ningbo Dacheng and Tongyizhong Specialty Fibre Technology and Development Co., Ltd. Gel-spun polyethylene fibers are prepared by spinning a solution of UHMWPE into solution filaments, cooling the solution filaments to a gel state, then removing the spinning solvent. One or more of the solution filaments, the gel filaments and the solvent-free filaments are drawn to a highly oriented state. The gel-spinning process discourages the formation of folded chain lamellae and favors formation of extended chain structures that more efficiently transmit tensile loads.

The first description of the preparation and drawing of UHMWPE filaments in the gel state was by P. Smith, P. J. Lemstra, B. Kalb and A. J. Pennings, *Poly. Bull.,* 1, 731 (1979). Single filaments were spun from 2 wt. % solution in decalin, cooled to a gel state and then stretched while evaporating the decalin in a hot air oven at 100 to 140° C.

More recent processes [see, e.g., U.S. Pat. Nos. 4,551,296, 4,663,101, and 6,448,659] describe drawing all three of the solution filaments, the gel filaments and the solvent-free filaments. A process for drawing high molecular weight polyethylene fibers is described in U.S. Pat. No. 5,741,451. Yet more recent drawing processes are described in co-pending U.S. application Ser. No. 10/934,675 and in United States Publication 20050093200. The disclosures of U.S. Pat. Nos. 4,551,296, 4,663,101, 5,741,451 and 6,448,659, U.S. application Ser. No. 10/934,675 and United States Publication 20050093200 are hereby incorporated by reference to the extent not incompatible herewith.

There may be several motivations for drawing gel-spun polyethylene filaments and yarns. The end-use applications may require low filament denier or low yarn denier. Low filament deniers are difficult to produce in the gel spinning process. Solutions of UHMWPE are of high viscosity and may require excessive pressures to extrude through small spinneret openings. Hence, use of spinnerets with larger openings and subsequent drawing may be a preferable approach to producing fine denier filaments. Another motivation for drawing may be a need for high tensile properties. Tensile properties of gel-spun polyethylene filaments generally improve with increased draw ratio if appropriately conducted. Yet another motivation for drawing may be to produce a special microstructure in the filaments that may be especially favorable for particular properties, for example, ballistic resistance.

Dynamic mechanical analysis (DMA) is the technique of applying a dynamic stress or strain to a sample and analyzing the response to obtain mechanical properties such as storage modulus (E'), loss modulus (E") and damping or tan delta (δ) as a function of temperature and/or frequency. An introductory description of DMA as applied to polymers has been presented by K. P. Menard in "Encyclopedia of Polymer Science and Technology", Volume 9, P. 563-589, John Wiley & Sons, Hoboken, N.J., 2004. Menard indicates that DMA is very sensitive to molecular motions of polymer chains and is a powerful tool for measuring transitions in such motions. Temperature regions in which transitions in molecular motion occur are marked by departure of E', E" or tan δ from base line trends and are variously termed "relaxations" and "dispersions" by investigators. DMA studies of many polymers have identified three temperature regions associated with dispersions designated alpha (α), beta (β) and gamma (γ).

Khanna et al., *Macromolecules,* 18, 1302-1309 (1985), in a study of polyethylenes having a range of densities (linearity), attributed the α-dispersion to molecular motions of chain folds, loops, and tie molecules at the interfacial regions of crystalline lamellae. The intensity of the α-dispersion increased with increasing lamellar thickness. The β-dispersion was attributed to molecular motions in the amorphous interlamellar regions. The origin of the γ-dispersion was not clear but was suggested to involve mostly the amorphous regions. Khanna et al. note that K. M. Sinnott, *J. Appl Phys.,* 37, 3385 (1966) proposed that the γ-dispersion was due to defects in the crystalline phase. In the same study, Khanna et al. associated the α-dispersion with transitions in molecular motions above about 5° C., the β-dispersion with transitions between about −70° C. and 5° C., and the γ-dispersion with a transition between about −70° C. and −120° C.

R. H. Boyd, *Polymer,* 26, 323 (1985) found that as crystallinity increased, the γ-dispersion tended to broaden. Roy et al., *Macromolecules,* 21(6), 1741 (1988) in a study of UHMWPE films gel-cast from very dilute solution (0.4% w/v) found that the γ-dispersion disappeared when the sample was hot drawn in the solid state in the region beyond 150:1. K. P. Menard (citation above) noted a correlation between toughness and the β-dispersion.

U.S. Pat. No. 5,443,904 suggested that high values of tan δ in the γ-dispersion could be indicative of excellent resistance to high speed impact, and that high peak temperature of the loss modulus in the α-dispersion was indicative of excellent physical properties at room temperature.

It should be noted that DMA instruments may be of different types and have different modes of operation that may effect the results obtained. A DMA instrument may impose a forced frequency on the sample or the instrument may be of a free resonance type. A forced frequency instrument may be operated in different modes (stress controlled or strain controlled). Since most dynamic mechanical analyses of polymers are run over a range of temperatures where the static force in the sample may change as a result of sample shrinkage, thermal expansion, or creep, it is necessary to have some mechanism to adjust the sample tension when temperature is changed. The DMA instrument may be run with a constant static force set at the start of the test to a value greater than the maximum dynamic force observed during the test. In this mode, the sample is prone to elongate as it softens on heating, resulting in a possible change in morphology. Alternatively, the DMA instrument may automatically control and adjust the static force to be a certain percent greater than the dynamic force. In this mode, the sample elongation and morphology change during the test are minimized and the DMA properties measured will be more representative of the original sample before heating.

SUMMARY OF THE INVENTION

The invention comprises drawn polyethylene multifilament yarns having unique DMA signatures reflective of unique microstructures and superior ballistic resistant properties. For the purposes of this invention, temperature regions where the loss modulus, E", departs from a base line trend are termed "dispersions". An α-dispersion is defined as one occurring in a temperature region above 5° C., a β-dispersion is one occurring in a temperature region from −70° C. to 5° C., and a γ-dispersion is one occurring in a temperature region from −70° C. to −120° C. The drawn polyethylene multi-filament yarns of the invention possess one or more unique characteristics in their DMA signature compared to prior art gel-spun multi-filament polyethylene yarns.

A γ-dispersion peak in the loss modulus, if any, is of very low amplitude.

The β-dispersion of the loss modulus is of high integral strength.

A peak in the α-dispersion is absent at a frequency of 10 radians/sec.

The integral strength of the β-dispersion is defined as the area between the DMA loss modulus plot and a base line drawn through the wings of the entire β-dispersion, measured in units of GPa-° C.

The invention also includes articles constructed from the inventive yarns.

In one embodiment, the invention is a drawn polyethylene multi-filament yarn comprising: polyethylene having an intrinsic viscosity in decalin at 135° C. of from about 5 dl/g to 45 dl/g, fewer than about two methyl groups per thousand carbon atoms, and less than about 2 wt. % of other constituents; said multi-filament yarn having a tenacity of at least 33 g/d as measured by ASTM D2256-02; and when measured by dynamic mechanical analysis on a Rheometrics Solids Analyzer RSA II in a force proportional mode in tension with the static force held at 110% of dynamic force, the dynamic strain at 0.025±0.005%, the heating rate at 2.7±0.8° C./min, and the frequency in the range of from 10 to 100 radians/sec, having a peak value of the loss modulus in a γ-dispersion less than 175 MPa above a base line drawn through the wings of the γ-dispersion peak.

In a second embodiment, the invention is a drawn polyethylene multi-filament yarn comprising: polyethylene having an intrinsic viscosity in decalin at 135° C. of from about 5 dl/g to 45 dl/g, fewer than about two methyl groups per thousand carbon atoms, and less than about 2 wt. % of other constituents; said multi-filament yarn having a tenacity of at least 33 g/d as measured by ASTM D2256-02, and when measured by dynamic mechanical analysis on a Rheometrics Solids Analyzer RSA II in a force proportional mode in tension with the static force held at 110% of dynamic force, the dynamic strain at 0.025±0.005%, the heating rate at 2.7±0.8° C./min and the frequency at 10 radians/sec, having in a temperature range of 50° C. to 125° C. and at a frequency of 10 radians/sec, no peak in the loss modulus having a full width at half height at least 10° C.

In a third embodiment, the invention is a drawn polyethylene multi-filament yarn comprising: polyethylene having an intrinsic viscosity in decalin at 135° C. of from about 5 dl/g to 45 dl/g, fewer than about two methyl groups per thousand carbon atoms, and less than about 2 wt. % of other constituents; said multi-filament yarn having a tenacity of at least 33 g/d as measured by ASTM D2256-02, and when measured by dynamic mechanical analysis on a Rheometrics Solids Analyzer RSA II in a force proportional mode in tension with the static force held at 110% of dynamic force, the dynamic strain at 0.025±0.005%, the heating rate at 2.7±0.8° C./min and the frequency at 10 radians/sec, having an integral strength of the β-dispersion of the loss modulus above a base line drawn through the wings of the β-dispersion at least 90 GPa-° C.

In a fourth embodiment, the invention is a drawn polyethylene multi-filament yarn comprising: polyethylene having an intrinsic viscosity in decalin at 135° C. of from about 5 dl/g to 45 dl/g, fewer than about two methyl groups per thousand carbon atoms, and less than about 2 wt. % of other constituents; said multi-filament yarn having a tenacity of at least 33 g/d as measured by ASTM D2256-02; when measured by dynamic mechanical analysis on a Rheometrics Solids Analyzer RSA II in a force proportional mode in tension with the static force held at 110% of dynamic force, the dynamic strain at 0.025±0.005%, the heating rate at 2.7±0.8° C./min and the frequency at 10 radians/sec, having a peak value of the loss modulus in a γ-dispersion less than 175 MPa above a base line drawn through the wings of the peak; and an integral strength of the β-dispersion of the loss modulus above a base line drawn through the wings of the dispersion at least 90 GPa-° C.

In a fifth embodiment, the invention is a drawn polyethylene multi-filament yarn comprising: polyethylene having an intrinsic viscosity in decalin at 135° C. of from about 5 dl/g to 45 dl/g, fewer than about two methyl groups per thousand carbon atoms, and less than about 2 wt. % of other constituents; said multi-filament yarn having a tenacity of at least 33 g/d as measured by ASTM D2256-02, and when measured by dynamic mechanical analysis on a Rheometrics Solids Analyzer RSA II in a force proportional mode in tension with the static force held at 110% of dynamic force, the dynamic strain at 0.025±0.005%, the heating rate at 2.7±0.8° C./min and the frequency at 100 radians/sec, having an integral strength of the β-dispersion of the loss modulus above a base line drawn through the wings of the β-dispersion at least 107 GPa-° C.

In a sixth embodiment, the invention is a drawn polyethylene multi-filament yarn comprising: polyethylene having an intrinsic viscosity in decalin at 135° C. of from about 5 dl/g to 45 dl/g, fewer than about two methyl groups per thousand carbon atoms, and less than about 2 wt. % of other constituents; said multi-filament yarn having a tenacity of at least 33 g/d as measured by ASTM D2256-02; and when measured by dynamic mechanical analysis on a Rheometrics Solids Analyzer RSA II in a force proportional mode in tension with the static force held at 110% of dynamic force, the dynamic strain at 0.025±0.005%, the heating rate at 2.7±0.8° C./min and the frequency at 100 radians/sec, having a peak value of the loss modulus in a γ-dispersion less than 225 MPa above a base line drawn through the wings of the γ-dispersion peak, and an integral strength of the β-dispersion of the loss modulus above a base line drawn through the wings of the β-dispersion at least 107 GPa-° C.

In a seventh embodiment, the invention is a drawn polyethylene multi-filament yarn comprising: polyethylene having an intrinsic viscosity in decalin at 135° C. of from about 5 dl/g to 45 dl/g, fewer than about two methyl groups per thousand carbon atoms, and less than about 2 wt. % of other constituents; said multi-filament yarn having a tenacity of at least 33 g/d as measured by ASTM D2256-02, and when measured by dynamic mechanical analysis on a Rheometrics Solids Analyzer RSA II in a force proportional mode in tension with the static force held at 110% of dynamic force, the dynamic strain at 0.025±0.005%, the heating rate at 2.7±0.8° C./min, and the frequency in the range of from 10 to 100 radians/sec, having a peak value of the loss modulus in a γ-dispersion, in proportion to the loss modulus of a base line drawn through the wings of said γ-dispersion peak, at the same temperature as said peak value, less than 1.05:1.

In an eighth embodiment, the invention is a drawn polyethylene multi-filament yarn comprising: polyethylene having an intrinsic viscosity in decalin at 135° C. of from about 5 dl/g to 45 dl/g, fewer than about two methyl groups per thousand carbon atoms, and less than about 2 wt. % of other constituents; said multi-filament yarn having a tenacity of at least 33 g/d as measured by ASTM D2256-02, and when measured by dynamic mechanical analysis on a Rheometrics Solids Analyzer RSA II in a force proportional mode in tension with the static force held at 110% of dynamic force, the dynamic strain at 0.025±0.005%, the heating rate at 2.7±0.8° C./min, and the frequency at 10 radians/sec, having a peak value of the loss modulus in a γ-dispersion, in proportion to the loss modulus of a base line drawn through the wings of said γ-dispersion peak, at the same temperature as said peak value, less than 1.05:1, and an integral strength of the β-dispersion of the loss modulus above a base line drawn through the wings of the β-dispersion at least 90 GPa-° C.

The invention also includes articles comprising the inventive yarns.

DETAILED DESCRIPTION OF THE INVENTION

Figure 1:
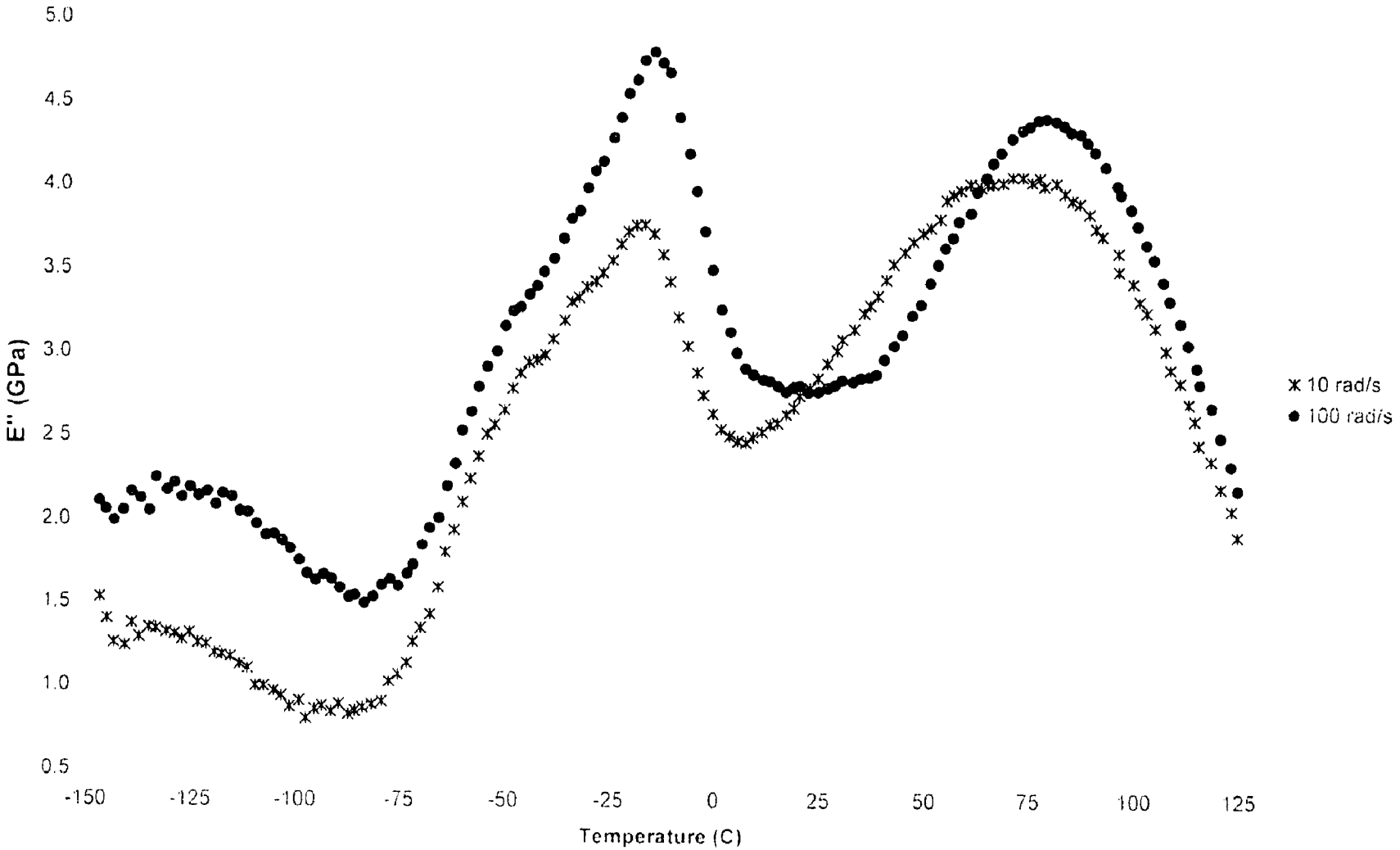
FIG. 1 shows plots of loss moduli at DMA frequencies of 10 and 100 radians/sec of a first prior art drawn UHMWPE yarn.

The invention comprises drawn polyethylene multi-filament yarns having unique DMA signatures reflective of unique microstructures and superior ballistic-resistant properties.

For purposes of the present invention, a fiber is an elongate body the length dimension of which is much greater than the transverse dimensions of width and thickness. Accordingly, "fiber" as used herein includes one, or a plurality of filaments, ribbons, strips, and the like having regular or irregular cross-sections in continuous or discontinuous lengths. A yarn is an assemblage of continuous or discontinuous fibers.

The multifilament yarn that is the precursor of the drawn yarn of the present invention may be gel-spun by any one of the processes described in U.S. Pat. Nos. 4,413,110; 4,536,536; 4,551,296; 4,663,101; 5,032,338; 5,286,435; 5,578,374; 5,736,244; 5,741,451; 5,958,582; 5,972,498; and 6,448,359 B1, or by other methods. Preferably, the precursor yarn is gel-spun by a process described in U.S. Pat. Nos. 4,551,296, 4,663,101, or 6,448,659. Preferably, the precursor yarn is spun from solution at a concentration of from 5 wt. % to 30 wt. %. The precursor yarn may be drawn in the solution state, in the gel state, or in the solid state, for example by the process of U.S. Pat. No. 5,741,451. Preferably, the gel-spun yarn that is the precursor to the yarn of the invention has been drawn in the solution state, in the gel state and in the solid state.

The drawn multi-filament yarns of the present invention comprise polyethylene having an intrinsic viscosity in decalin at 135° C. of from about 5 dl/g to about 45 dl/g, fewer than about two methyl groups per thousand carbon atoms and less than 2 wt. % of other constituents. Preferably, the multi-filament yarn of the invention comprises polyethylene having an intrinsic viscosity in decalin at 135° of from about 10 dl/g to about 30 dl/g, fewer than about one methyl groups per thousand carbon atoms and less than 1 wt. % of other constituents. Most preferably, the multi-filament yarns of the invention comprises polyethylene having fewer than about 0.5 methyl groups per thousand carbon atoms.

For the purposes of this invention, temperature regions where the loss modulus, E", departs from a base line trend are termed "dispersions". An α-dispersion is defined as one occurring in a temperature region above 5° C., a β-dispersion is one occurring in a temperature region from −70° C. to 5° C., and a γ-dispersion is one occurring in a temperature region from −70° C. to −120° C. The β-dispersion of the loss modulus may have two components. The components of the β-dispersion may be a shoulder and a distinct peak or the components may be two distinct peaks.

The multi-filament yarns of the invention have a tenacity of at least 33 grams/denier (g/d) as measured by ASTM D2256-02. Preferably the tenacity is at least 39 g/d. The yarns of the invention may have on their surface spin finishes, anti-static agents, lubricants or other agents commonly used in fiber processing.

The inventive yarns and several prior art yarns have been characterized by dynamic mechanical analysis (DMA) in a proportional force mode in tension with the static force held at 110% of dynamic force, the dynamic strain at 0.025±0.005%, the heating rate at 2.7±0.8° C./min, and the frequency at 10 and 100 radians/sec. The DMA instrument employed was a model RSA II from Rheometrics Scientific (now TA Instruments, New Castle Del.). This DMA instrument is of the strain controlled type.

The multi-filament yarns of the invention have unique DMA signatures. In one embodiment, in comparison to prior art gel-spun multi-filament yarns, a yarn of the invention has a very low amplitude peak, if any, in the γ-dispersion. More precisely, in this embodiment, a multi-filament yarn of the invention has a peak value of the loss modulus in a γ-dispersion less than 175 MPa above a base line drawn through the wings of a γ-dispersion peak. Preferably, the peak value of the loss modulus in a γ-dispersion is less than 100 MPa above a base line drawn through the wings of a γ-dispersion peak.

In a second embodiment, a multi-filament yarn of the invention, measured at a frequency of 10 radians/sec in a temperature range of 50° C. to 125° C., has no peak in the loss modulus having a full width at half height at least 10° C.

In a third embodiment, a multi-filament yarn of the invention has a uniquely high integral strength of the β-dispersion of the loss modulus. The integral strength of the β-dispersion is defined as the area between the DMA loss modulus plot and a base line drawn through the wings of the β-dispersion as illustrated in FIG. 1. In this embodiment, measured at a frequency of 10 radians/sec, the integral strength of the loss modulus is at least 90 GPa-° C. Preferably, the β-dispersion of the loss modulus has two components. Preferably also, no peak is seen in the loss modulus in a temperature range of 50° C. to 125° C. having a full width at half height at least 10° C.

In a fourth embodiment, a multi-filament yarn of the invention, measured at a frequency of 10 radians/sec, has a peak value of the loss modulus in a γ-dispersion less than 175 MPa above a base line drawn through the wings of a γ-dispersion peak, and an integral strength of the loss modulus at least 90 GPa-° C. Preferably, the peak value of the loss modulus in a γ-dispersion is less than 100 MPa above a base line drawn through the wings of a γ-dispersion peak. Preferably, the β-dispersion dispersion of the loss modulus has two components, as previously described.

In a fifth embodiment, a multi-filament yarn of the invention, measured at a frequency of 100 radians/sec, has an integral strength of the loss modulus at least 107 GPa-° C. Preferably, the β-dispersion of the loss modulus has two components.

In a sixth embodiment, a multi-filament yarn of the invention, measured at a frequency of 100 radians/sec, has a peak value of the loss modulus in a γ-dispersion less than 225 MPa above a base line drawn through the wings of a γ-dispersion peak, and an integral strength of the loss modulus at least 107 GPa-° C. Preferably, the peak value of the loss modulus in a γ-dispersion is less than 130 MPa above a base line drawn through the wings of a γ-dispersion peak. Preferably, the β-dispersion of the loss modulus has two components.

In a seventh embodiment, a multi-filament yarn of the invention measured at a frequency of 10 to 100 radians/sec, has a peak value of the loss modulus in a γ-dispersion, in proportion to the loss modulus of a base line drawn through the wings of said γ-dispersion peak, at the same temperature as said peak value, less than 1.05:1. Preferably, no peak is seen in the loss modulus in a temperature range of 50° C. to 125° C. having a full width at half height at least 10° C.

In an eighth embodiment, a multi-filament yarn of the invention measured at a frequency of 10 radians/sec, has a peak value of the loss modulus in a γ-dispersion, in proportion to the loss modulus of a base line drawn through the wings of said γ-dispersion peak, at the same temperature as said peak value, less than 1.05:1, and an integral strength of the β-dispersion at least 90 GPa-° C. Preferably, the β-dispersion of the loss modulus has two components.

The invention also includes articles comprising the inventive yarns. The articles of the invention are preferably comprised of networks of the inventive yarns. By network is meant the fibers of the yarns arranged in configurations of various types. For example, the fibers of the yarns may be formed into a felt, a knitted or woven fabric, a non-woven fabric (random or ordered orientation), arranged in parallel array, layered, or formed into a fabric by any of a variety of conventional techniques.

Preferably, the articles of the invention are comprised of at least one network of the inventive yarns. More preferably, an article of the invention is comprised of a plurality of networks of the inventive yarns, the networks being arranged in unidirectional layers, the direction of the fibers in one layer being at an angle to the direction of the fibers in adjacent layers.

The drawn gel-spun multi-filament yarns and articles of the invention possess superior ballistic resistant properties.

EXAMPLES

Comparative Example 1

The tensile properties of a first prior art drawn UHMWPE yarn were by measured by ASTM D2256-02 and are shown in Table I.

The yarn was subjected to dynamic mechanical analysis in tension using a Rheometrics Solids Analyzer RSA II from Rheometrics Scientific (now TA Instruments, Inc., New Castle, Del.). The analyst entered into the instrument the frequency levels (10 and 100 radians/sec), a strain level, the proportion between the static force and the dynamic force (110%), the temperature interval between measurements (2° C.), and the cross-sectional area of the yarn sample as determined from its denier (Table I). The DMA sample consisted of a length of the entire yarn bundle. Removal of filaments from the yarn and testing of individual filaments or fractions of the total yarn bundle is to be avoided to prevent damaging or stretching entangled filaments, thereby changing their properties. Problems of sampling yarns with non-uniform filaments across the bundle are also thereby avoided.

The sample and instrument were cooled to the starting temperature and the instrument began measurements. It first measured yarn properties at a frequency of 10 radians/sec for a period of several seconds, averaging the measurements. Then, at the same temperature, it measured yarn properties at a frequency of 100 radians/sec for a period of several seconds averaging and recording the measurements. The instrument then ramped up the temperature 2° C., held the temperature for about 10 seconds, and then began measuring again at frequencies of 10 and 100 radians/sec. This process continued until the final temperature was reached. The average heating rate and standard deviation of heating rate during the run was 2.7±0.8° C./min. Because of instrument compliance the actual strain level experienced by the sample differed from the set value. The sample strain varied somewhat during a run as the temperature changed. The average strain and standard deviation was 0.025±0.005%.

Plots of the loss modulus, E", versus temperature for this prior art yarn are shown in FIG. 1. Peaks were seen in the γ-dispersion at a temperature of −125° C. at a frequency of 10 radians/sec, and at a temperature of −119° C. at a frequency of 100 radians/sec. Measurements of the heights of the γ-dispersion of the loss modulus above base lines drawn through the wings of the peaks showed the amplitude of the γ-dispersion to be 252 MPa at 10 radians/sec, and 432 MPa at 100 radians/sec. The base line 10 of the γ-dispersion at 100 radians/sec is illustrated in FIG. 1. The ratios of the peak values of the loss moduli in the γ-dispersion to the base line loss moduli at the same temperature as the peaks were 1.234:1 at 10 radians/sec and 1.241:1 at 100 radians/sec.

The β-dispersion showed two components: low temperature shoulders at −50° C. at both 10 and 100 radians/sec, and distinct peaks at −17° C. and at −14° C. for 10 and 100 radians/sec respectively. The lower temperature component of the β-dispersion is hereinafter denoted as β(1), and the higher temperature component is denoted as β(2).

The area between the E" plot and a base line 20 (illustrated in FIG. 1 for 100 radians/sec) drawn though the wings of the β-dispersion was determined by numerical integration. The integral strengths of the β-dispersions were 84.9 GPa-° C. and 105.3 GPa-° C. at 10 and 100 radians/sec respectively.

The α-dispersion showed peaks at 73° C. and at 81° C. for frequencies of 10 and 100 radians/sec respectively.

The DMA measurements for this yarn are summarized in Table II below.

Comparative Example 2

The tensile properties of a second prior art drawn UHMWPE yarn were by measured by ASTM D2256-02 and are shown in Table I.

Figure 2:
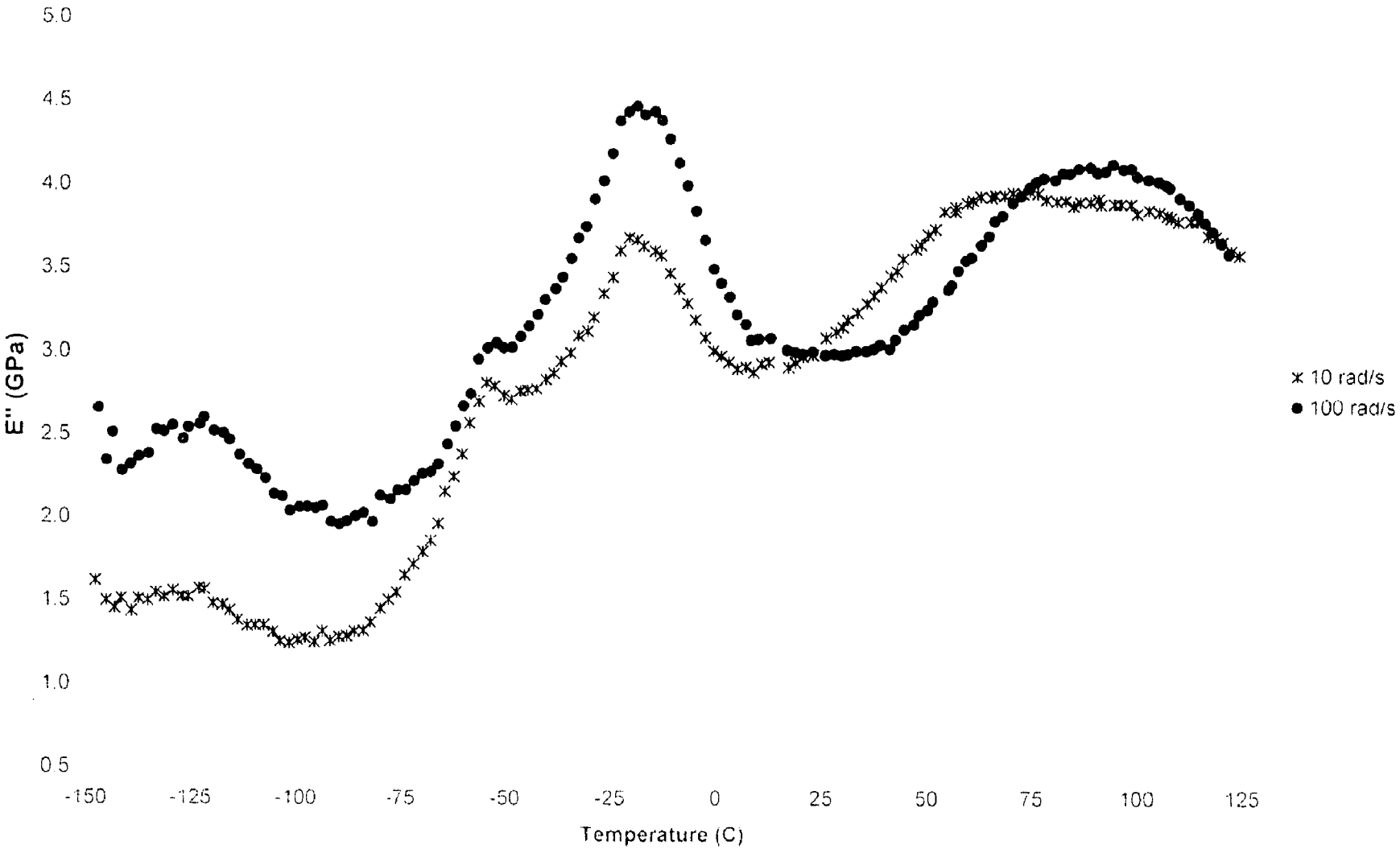
FIG. 2 shows plots of loss moduli at DMA frequencies of 10 and 100 radians/sec of a second prior art drawn UHMWPE yarn.

The yarn was subjected to dynamic mechanical analysis in tension as described in Comparative Example 1. Plots of the loss modulus, E", for this prior art yarn are shown in FIG. 2. Peaks were seen in the γ-dispersion at a temperature of −123° C. at a frequency of 10 radians/sec, and at a temperature of −122° C. at a frequency of 100 radians/sec. Measurements of the height of the γ-dispersion above base lines drawn through the wings of the peaks showed the amplitude of the γ-dispersion peaks to be 252 MPa at 10 radians/sec, and 432 MPa at 100 radians/sec. The ratios of the peak values of the loss moduli in the γ-dispersion to the base line loss moduli at the same temperature as the peaks were 1.190:1 at 10 radians/sec and 1.200:1 at 100 radians/sec.

The β-dispersion showed β(1) peaks at −55° C. and −52° C. for 10 and 100 radians/sec respectively, and β(2) peaks at −21° C. and −17° C. for 10 and 100 radians/sec respectively. The integral strengths of the β-dispersions were 63.0 GPa-° C. and 79.6 GPa-° C. at 10 and 100 radians/sec respectively.

The α-dispersion showed peaks at 79° C. and at 93° C. for frequencies of 10 and 100 radians/sec respectively.

The DMA measurements for this yarn are summarized in Table II below.

Comparative Example 3

The tensile properties of a third prior art drawn UHMWPE yarn were by measured by ASTM D2256-02 and are shown in Table I.

Figure 3:
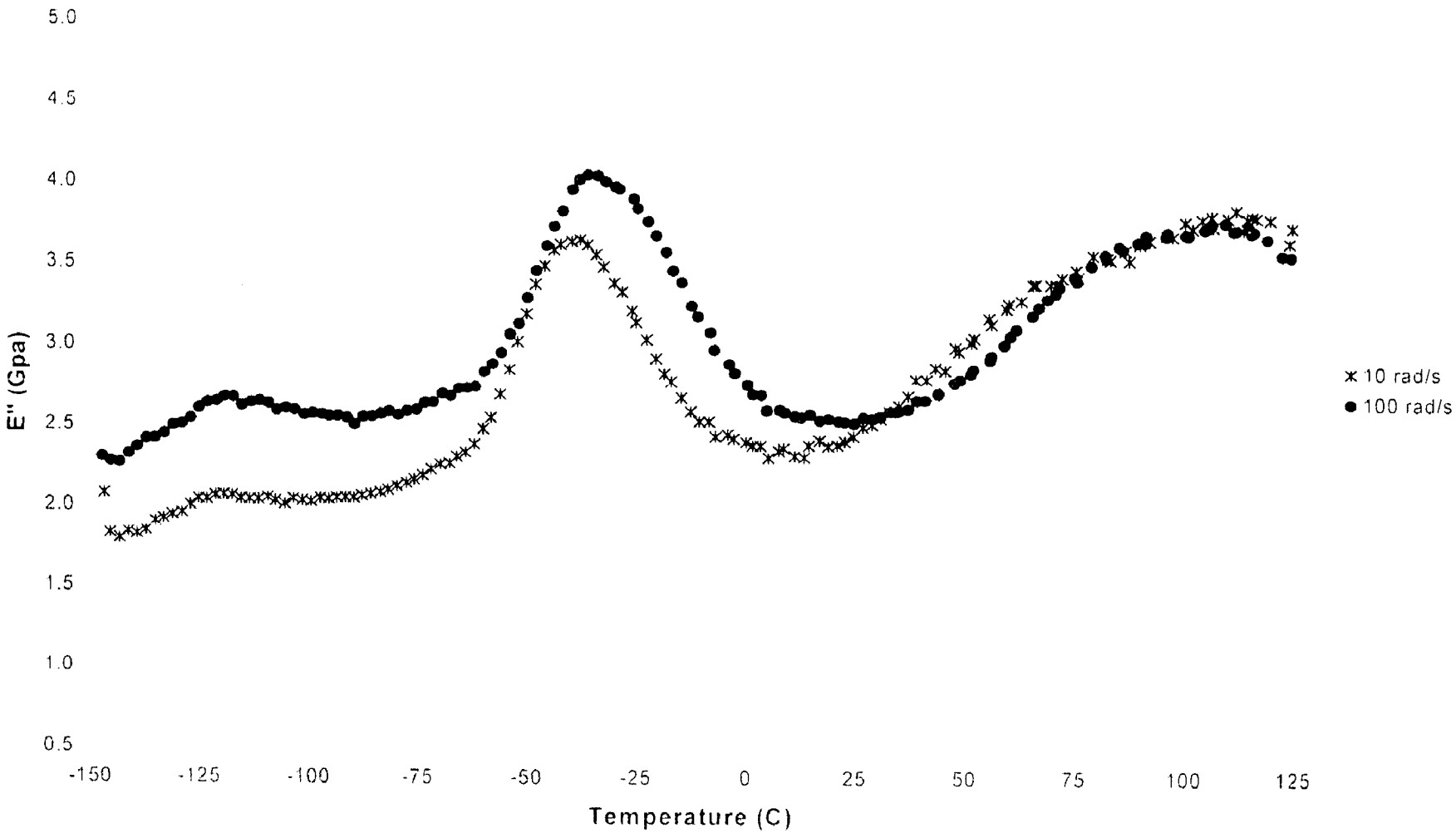
FIG. 3 shows plots of loss moduli at DMA frequencies of 10 and 100 radians/sec of a third prior art drawn UHMWPE yarn.

The yarn was subjected to dynamic mechanical analysis in tension as described in Comparative Example 1. Plots of the loss modulus, E", for this prior art yarn are shown in FIG. 3. Peaks are seen in the γ-dispersion at a temperature of −118° C. at both 10 radians/sec, and at 100 radians/sec. Measurements of the height of the γ-dispersion above base lines drawn through the wings of the peaks show the amplitude of the γ-dispersion peaks to be 182 MPa at 10 radians/sec, and 328 MPa at 100 radians/sec. The ratios of the peak values of the loss moduli in the γ-dispersion to the base line loss moduli at the same temperature as the peaks were 1.097:1 at 10 radians/sec and 1.137:1 at 100 radians/sec.

The β-dispersion had only one component with peaks at −38° C. and at −37° C. for 10 and 100 radians/sec respectively. The integral strengths of the β-dispersions were 53.9 GPa-° C. and 60.5 GPa-° C. at 10 and 100 radians/sec respectively.

The α-dispersion shows peaks at 112° C. and at 109° C. for frequencies of 10 and 100 radians/sec respectively.

The DMA measurements for this yarn are summarized in Table II below.

Comparative Example 4

The tensile properties of a fourth prior art drawn UHMWPE yarn were by measured by ASTM D2256-02 and are shown in Table I.

Figure 4:
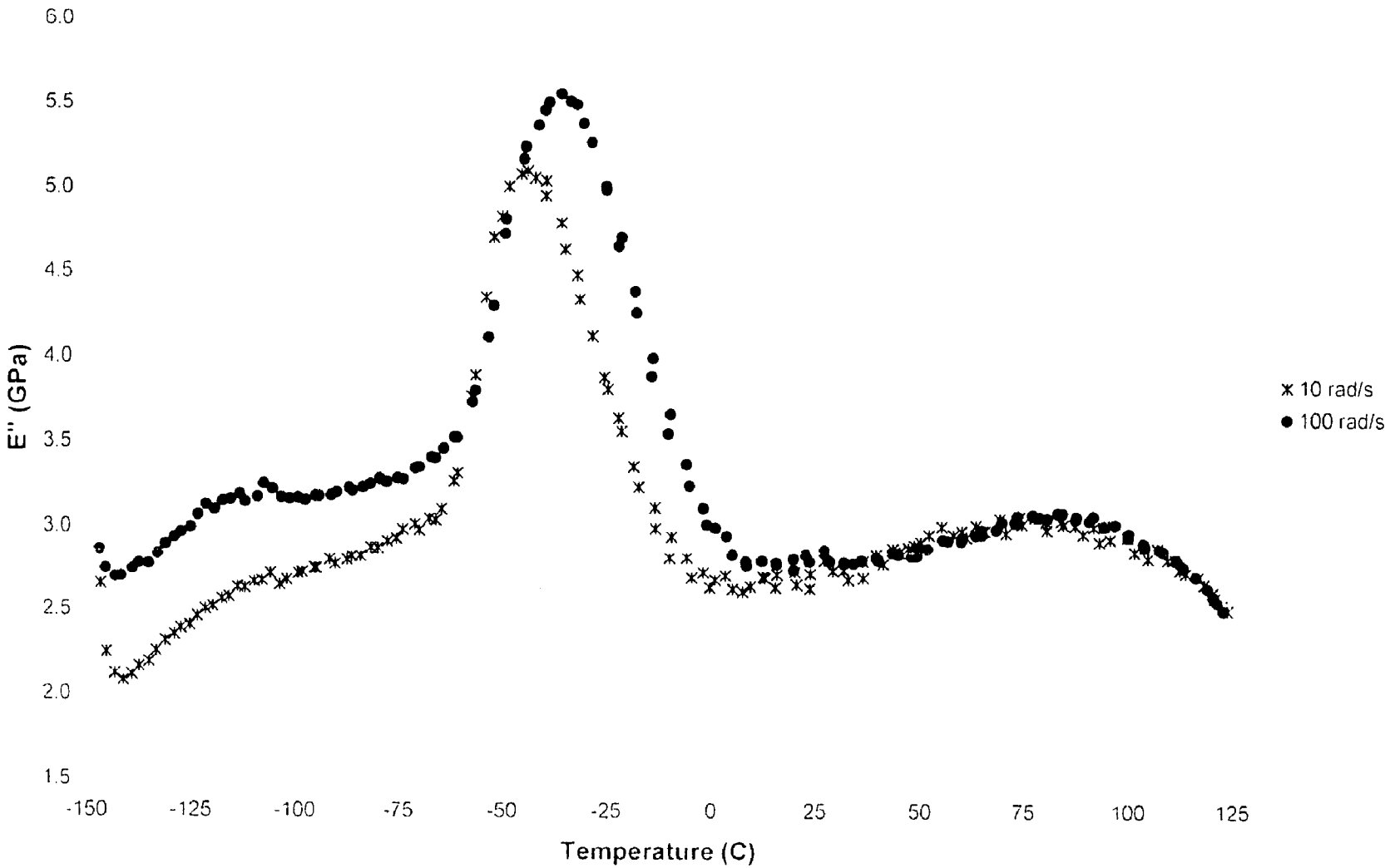
FIG. 4 shows plots of loss moduli at DMA frequencies of 10 and 100 radians/sec of a fourth prior art drawn UHMWPE yarn.

The yarn was subjected to dynamic mechanical analysis in tension as described in Comparative Example 1. Plots of the loss modulus, E", for this prior art yarn are shown in FIG. 4. Peaks were seen in the γ-dispersion at temperatures of −106° C. and −118° C. at 10 radians/sec and 100 radians/sec respectively. Measurements of the height of the γ-dispersion above base lines drawn through the wings of the peaks show the amplitude of the γ-dispersion peaks to be 218 MPa at 10 radians/sec, and 254 MPa at 100 radians/sec. The ratios of the peak values of the loss moduli in the γ-dispersion to the base line loss moduli at the same temperature as the peaks were 1.089:1 at 10 radians/sec and 1.088:1 at 100 radians/sec.

The β-dispersion had only one component with peaks at −43° C. and at −36° C. for 10 and 100 radians/sec respectively. The integral strengths of the β-dispersions were 85.3 GPa-° C. and 99.2 GPa-° C. at 10 and 100 radians/sec respectively.

The α-dispersion showed peaks at 78° C. and at 84° C. for frequencies of 10 and 100 radians/sec respectively.

The DMA measurements for this yarn are summarized in Table II below.

Comparative Example 5

The tensile properties of a fifth prior art drawn UHMWPE yarn were measured by ASTM D2256-02 and are shown in Table I.

Figure 5:
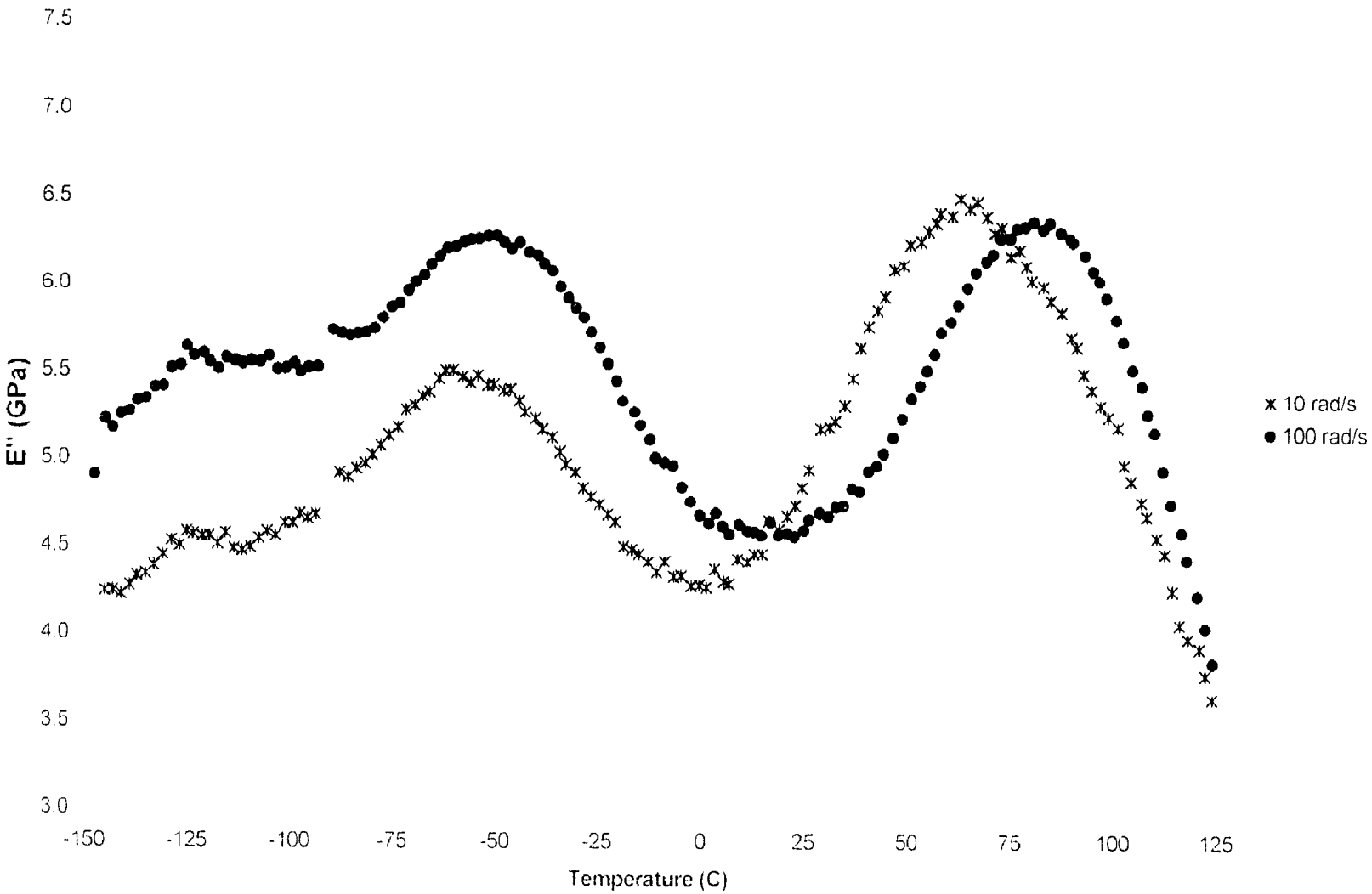
FIG. 5 shows plots of loss moduli at DMA frequencies of 10 and 100 radians/sec of a fifth prior art drawn UHMWPE yarn.

The yarn was subjected to dynamic mechanical analysis in tension as described in Comparative Example 1. Plots of the loss modulus, E", for this prior art yarn are shown in FIG. 5. Peaks were seen in the γ-dispersion at temperatures of −120° C. and −116° C. at 10 radians/sec and 100 radians/sec respectively. Measurements of the height of the γ-dispersion above base lines drawn through the wings of the peaks show the amplitude of the γ-dispersion peaks to be 252 MPa at 10 radians/sec, and 288 MPa at 100 radians/sec. The ratios of the peak values of the loss moduli in the γ-dispersion to the base line loss moduli at the same temperature as the peaks were 1.059:1 at 10 radians/sec and 1.055:1 at 100 radians/sec.

The β-dispersion had only one component with peaks at −58° C. and at −50° C. for 10 and 100 radians/sec respectively. The integral strengths of the β-dispersions were 54.4 GPa-° C. and 61.1 GPa-° C. at 10 and 100 radians/sec respectively.

The α-dispersion showed peaks at 67° C. and at 83° C. for frequencies of 10 and 100 radians/sec respectively.

The DMA measurements for this yarn are summarized in Table II below.

Example 1

A multi-filament polyethylene precursor yarn was gel-spun from a 10 wt. % solution as described in U.S. Pat. No. 4,551,296. This precursor yarn had been stretched in the solution state, in the gel state and in the solid state. The draw ratio in the solid state was 2.54:1. The yarn of 181 filaments had a tenacity of about 15 g/d.

This precursor yarn was fed from a creel, through a set of restraining rolls at a speed ($V_1$) of 11.1 meters/min into a forced convection air oven in which the internal temperature was 150±1° C. The air circulation within the oven was in a turbulent state with a time-averaged velocity in the vicinity of the yarn of about 34 meters/min.

The yarn was passed through the oven in a straight line from inlet to outlet over a path length (L) of 21.95 meters and thence to a second set of rolls operating at a speed ($V_2$) of 50 meters/min. The precursor yarn was thereby drawn in the oven at constant tension neglecting the effect of air drag. The yarn was cooled down on the second set of rolls at constant length neglecting thermal contraction producing a yarn of the invention. The drawing conditions satisfied the following relationships claimed in co-pending U.S. patent application Ser. No. 10/934,675.

$$0.25 \leqq [L/V_1 = 1.98] \leqq 20, \text{ min}$$

$$3 \leqq [V_2/V_1 = 4.50] \leqq 20$$

$$1.7 \leqq [(V_2 - V_1)/L = 1.77] \leqq 60, \text{ min}^{-1}$$

$$0.20 \leqq [2L/(V_1 + V_2) = 0.72] \leqq 10, \text{ min}$$

The drawn multi-filament yarn of the invention possessed a tenacity of 41.2 g/d as measured by ASTM D2256-02. The tensile properties of this yarn are shown in Table I. The yarn was comprised of polyethylene having an intrinsic viscosity in decalin at 135° C. of 11.5 dl/g, fewer than about 0.5 methyl groups per thousand carbon atoms, and contained less than 2 wt % of other constituents.

Figure 6:
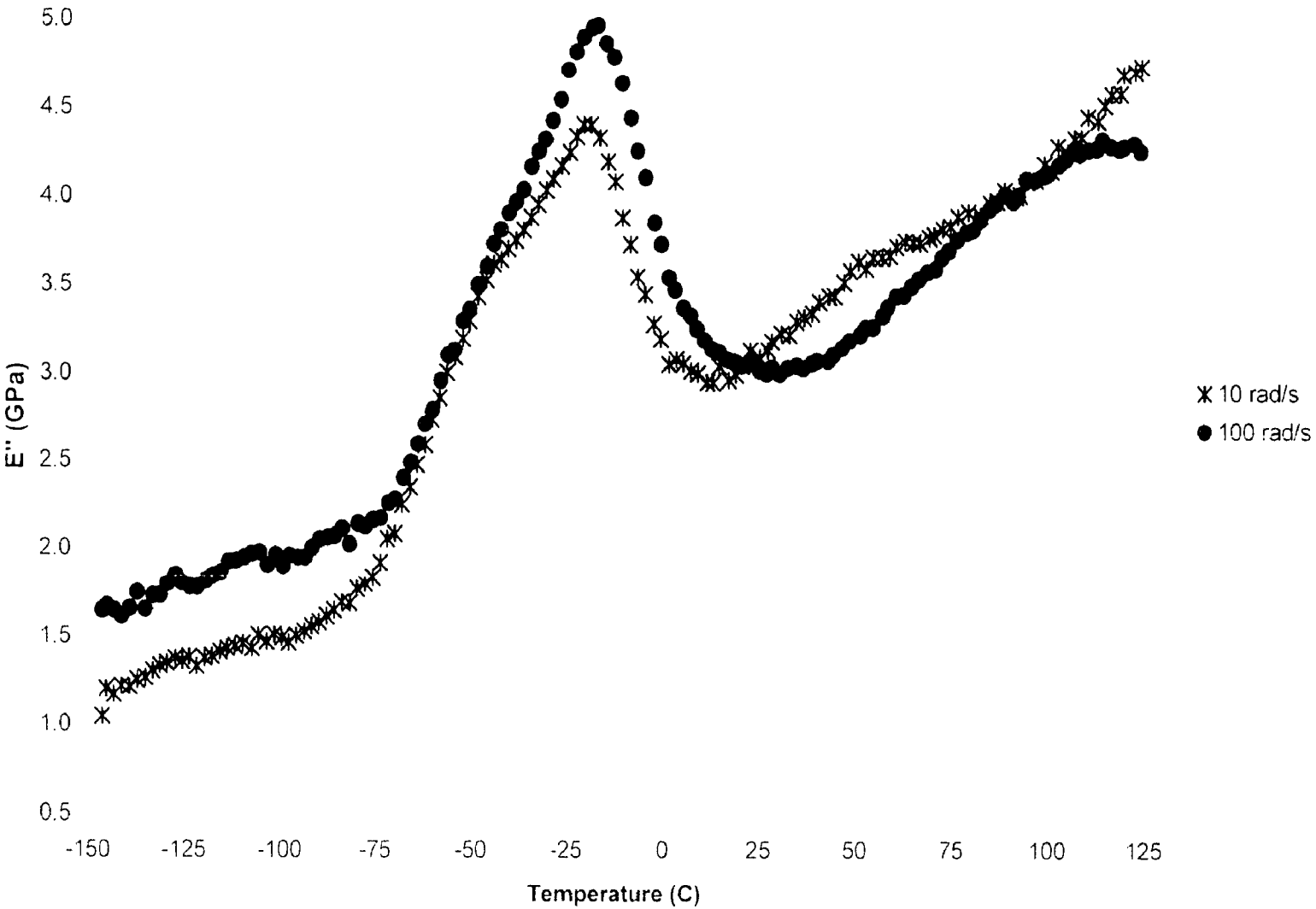
FIGS. 6-8 show plots of loss moduli at DMA frequencies of 10 and 100 radians/sec of drawn UHMWPE multi-filament yarns of this invention.

The yarn of the invention was subjected to dynamic mechanical analysis in tension as described in Comparative Example 1. Plots of the loss modulus, E", for this yarn are shown in FIG. 6. A peak in the γ-dispersion having a magnitude at least 100 MPa above a base line was absent at 10 radians/sec. A peak in the γ-dispersion having a magnitude; 3t least 130 MPa above a base line was absent at 100 radians/sec.

The β-dispersion showed β(1) shoulders at −50° C. for both 10 and 100 radians/sec respectively, and β(2) peaks at −21° C. and −17° C. for 10 and 100 radians/sec respectively. The integral strengths of the β-dispersions were 92.5 GPa-° C. and 107 GPa-° C. at 10 and 100 radians/sec respectively.

The α-dispersion was absent at a frequency of 10 radians/sec and had a peak at 123° C. at 100 radians/sec.

The DMA measurements for the inventive yarn are summarized in Table II.

Example 2

A multi-filament polyethylene precursor yarn was gel-spun from a 10 wt. % solution as described in U.S. Pat. No. 4,551,296. This precursor yarn had been stretched in the solution state, in the gel state and in the solid state. The draw ratio in the solid state was 1.55:1. The yarn of 181 filaments had a tenacity of 15 g/d. This precursor yarn was fed from a creel, through a set of restraining rolls and stretched in a forced circulation air oven at conditions similar to those of Example 1.

The drawn multi-filament yarn of the invention thereby produced possessed a tenacity of 39.7 g/d as measured by ASTM D2256-02. The tensile properties of this yarn are shown in Table I. The yarn was comprised of polyethylene having an intrinsic viscosity in decalin at 135° C. of 12 dl/g, fewer than about 0.5 methyl groups per thousand carbon atoms, and contained less than 2 wt % of other constituents.

Figure 7:
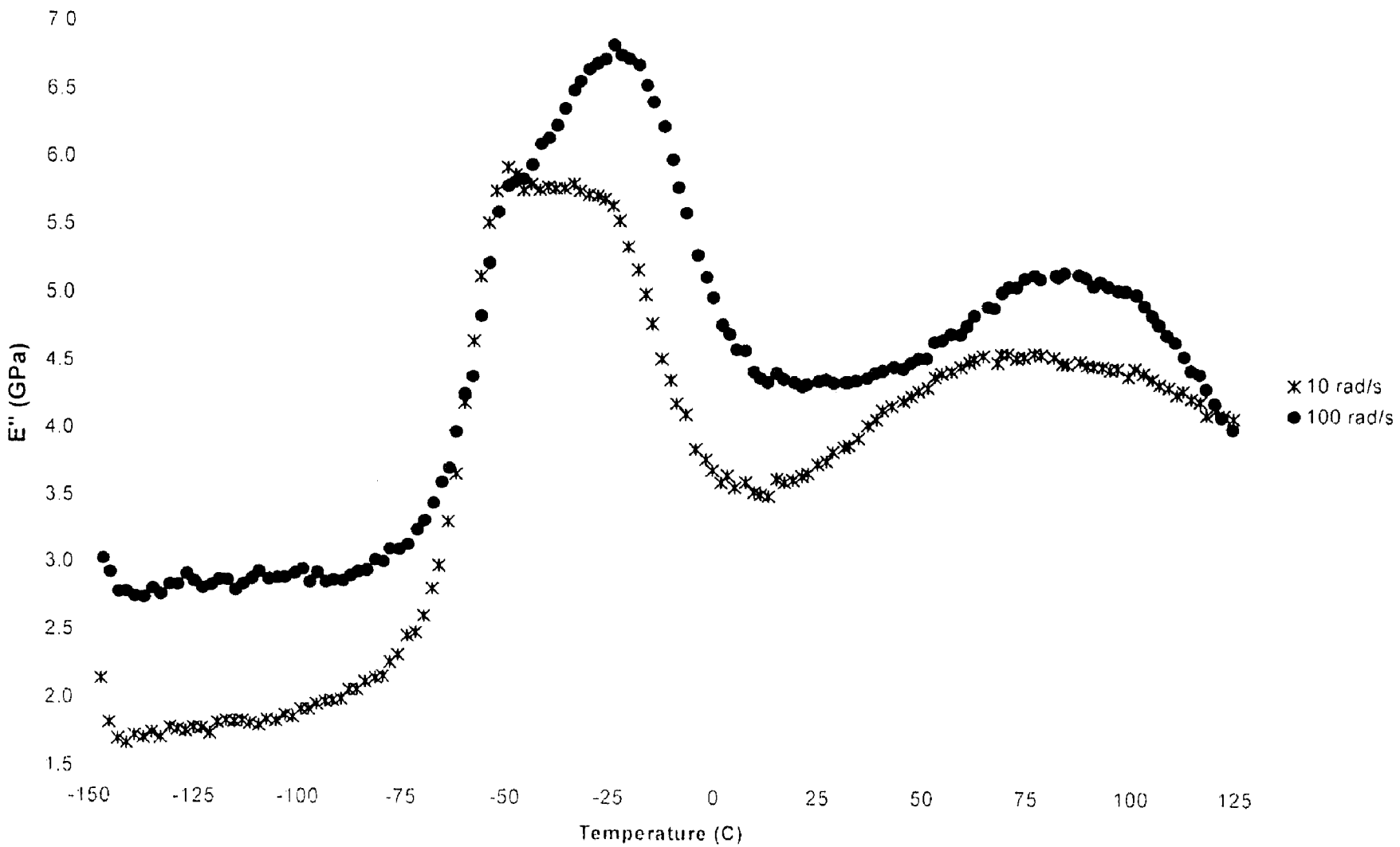

The yarn of the invention was subjected to dynamic mechanical analysis in tension as described in Comparative Example 1. Plots of the loss modulus, E", for this yarn are shown in FIG. 7. A peak in the γ-dispersion having a magnitude at least 100 MPa above a base line was absent at 10 radians/sec. A peak in the γ-dispersion having a magnitude at least 130 MPa above a base line was absent at 100 radians/sec.

The β-dispersion showed β(1) shoulders at −50° C. at both 10 and 100 radians/sec, and β(2) peaks at −34° C. and −25° C. at 10 and 100 radians/sec respectively. The integral strengths of the β-dispersions were 149 GPa-° C. and 152 GPa-° C. at 10 and 100 radians/sec respectively.

The α-dispersion showed peaks at 74° C. and at 84° C. for frequencies of 10 and 100 radians/sec respectively.

The DMA measurements for the inventive yarn are summarized in Table II below.

Example 3

This example was a complete repetition of Example 2 beginning with the preparation of the precursor yarn. The drawn multi-filament yarn of the invention possessed a tenacity of 38.9 g/d as measured by ASTM D2256-02. The tensile properties of this yarn are shown in Table I. The yarn was comprised of polyethylene having an intrinsic viscosity in decalin at 135° C. of 12 dl/g, fewer than about 0.5 methyl groups per thousand carbon atoms, and contained less than 2 wt % of other constituents.

Figure 8:
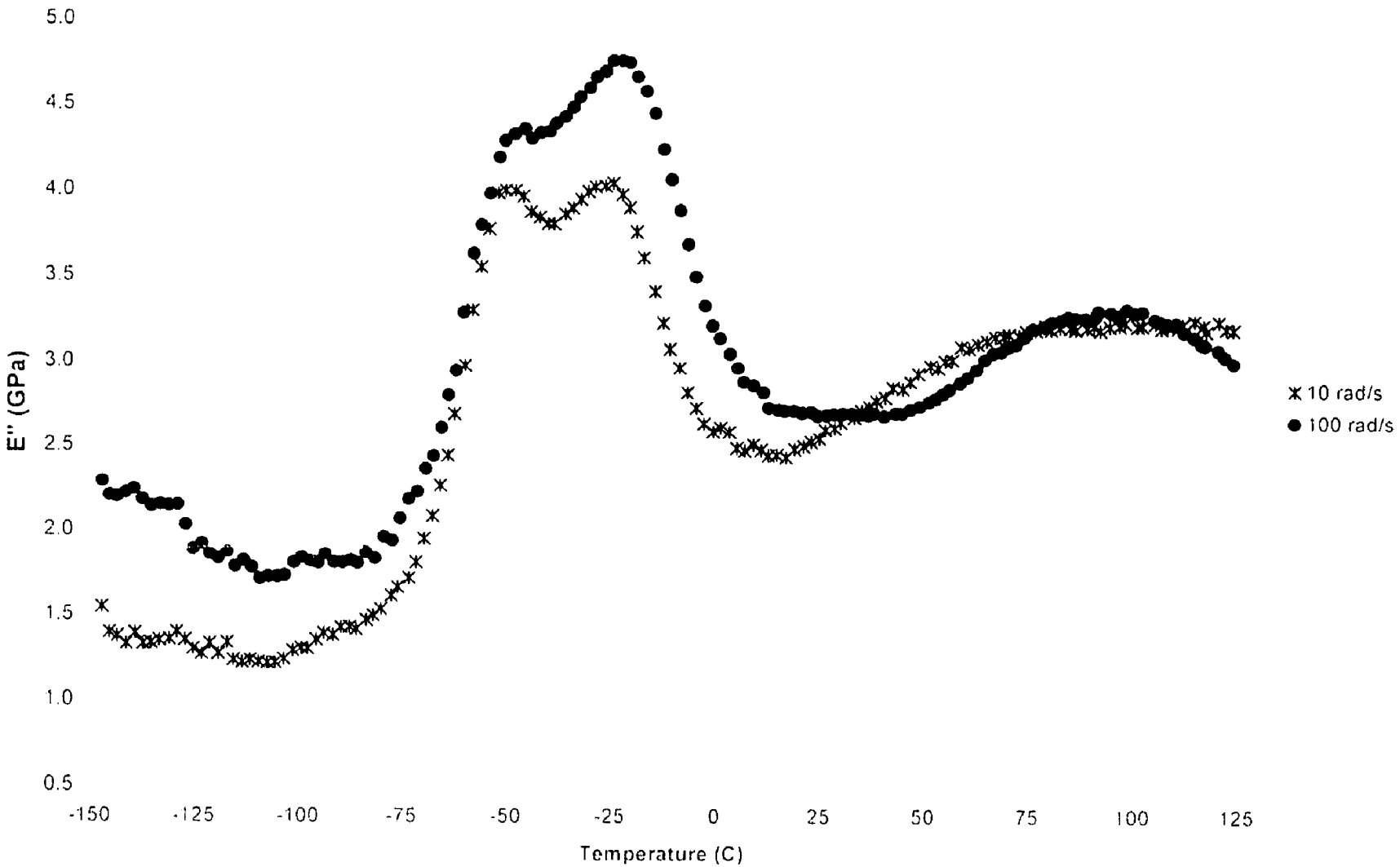

The yarn of the invention was subjected to dynamic mechanical analysis in tension as described in Comparative Example 1. Plots of the loss modulus, E", for this yarn are shown in FIG. 8. A peak in the γ-dispersion having a magnitude at least 100 MPa above a base line was absent at 10 radians/sec. A peak in the γ-dispersion having a magnitude at least 130 MPa above a base line was absent at 100 radians/sec.

The β-dispersion showed β(1) peaks at −50° C. and −48° C. for 10 and 100 radians/sec respectively, and β(2) peaks at −25° C. and −22° C. for 10 and 100 radians/sec respectively. The integral strengths of the β-dispersions were 111 GPa-° C. and 135 GPa-° C. at 10 and 100 radians/sec respectively.

The α-dispersion showed peaks at 81° C. and at 95° C. for frequencies of 10 and 100 radians/sec respectively.

The DMA measurements for the inventive yarn are summarized in Table II below.

It has been seen that the DMA signatures of drawn multi-filament gel-spun polyethylene yarns of the invention differ from those of prior art gel-spun polyethylene yarns in one or more of the following ways, taken individually or in several combinations.

- A γ-dispersion peak in the loss modulus, if any, is of very low amplitude.
- The β-dispersion of the loss modulus is of high integral strength.
- A peak in the α-dispersion is absent at a frequency of 10 radians/sec.

The inventive yarns also show two components in the β-dispersion of the loss modulus.

Without being held to a particular theory, it is believed that the essential absence of γ-dispersion peak in the loss modulus for the inventive yarns is reflective of a low defect density in the crystalline phase, i.e. long runs of straight chain all trans —$(CH_2)_n$— sequences. This is consistent with the DSC evidence reported in U.S. patent application Ser. No. 10/934,675. Accepting that the origin of the β-dispersion is molecular motion in the inter-crystalline regions, the presence of two components in the β-dispersion is believed to be reflective of the presence of two orthorhombic crystalline phases with different modes of connectivity in the inter-crystalline regions. This is consistent with the x-ray evidence reported in U.S. patent application Ser. No. 10/934,675 and U.S. Pat. No. 6,448,659. The unusually high integral strength of the β-dispersion of the loss modulus is suggestive of a high degree of molecular alignment in the intercrystalline regions. In total, the DMA data suggests, and is consistent with, a high degree of molecular alignment and crystalline perfection in the yarns of the invention.

TABLE I

Tensile Properties of Yarns Characterized by DMA

| Example | Yarn Denier | Tenacity, g/d | Modulus, g/d | Elongation at Break, % | Energy-to Break, J/g |
|---|---|---|---|---|---|
| Comp. 1 | 1189 | 30.4 | 885 | 3.7 | 56 |
| Comp. 2 | 1326 | 35.6 | 1120 | 3.5 | 61 |
| Comp. 3 | 1587 | 35.3 | 1062 | 3.6 | 62 |
| Comp. 4 | 1591 | 39.0 | 1205 | 3.4 | 65 |
| Comp. 5 | 422 | 38.6 | 1122 | 3.5 | n.d. |
| 1 | 691 | 41.2 | 1280 | 3.5 | n.d. |
| 2 | 1481 | 39.7 | 1291 | 3.3 | 65 |
| 3 | 1490 | 38.9 | 1258 | 3.3 | 64 |

n.d.—not determined

TABLE II

DMA Characteristics of Prior Art and Inventive Yarns

| Example | Alpha Dispersion Peak Temperature T, C. | Beta Dispersion Beta (1) T, C. | Beta (2) T, C. | Integral Strength GPa-deg. C. | Gamma Dispersion Peak Temperature T, C. | Height Over Base Line MPa | Peak-to-Base Line Ratio Dimensionless |
|---|---|---|---|---|---|---|---|
| 10 rad/sec | | | | | | | |
| Comp. 1 | 73 | −50 | −17 | 84.9 | −125 | 252 | 1.234 |
| Comp. 2 | 79 | −55 | −21 | 63.0 | −123 | 252 | 1.190 |
| Comp. 3 | 112 | Absent | −38 | 53.9 | −118 | 182 | 1.097 |
| Comp. 4 | 78 | Absent | −43 | 85.3 | −106 | 218 | 1.089 |
| Comp. 5 | 67 | −58 | Absent | 54.4 | −120 | 252 | 1.059 |
| 1 | Absent | −50 | −21 | 92.5 | Absent | <100 | 1.000 |
| 2 | 74 | −50 | −34 | 149 | Absent | <100 | 1.000 |
| 3 | 81 | −50 | −25 | 111 | Absent | <100 | 1.000 |
| 100 rad/sec | | | | | | | |
| Comp. 1 | 81 | −50 | −14 | 105.3 | −119 | 432 | 1.241 |
| Comp. 2 | 93 | −52 | −17 | 79.6 | −122 | 432 | 1.200 |
| Comp. 3 | 109 | Absent | −37 | 60.5 | −118 | 328 | 1.137 |
| Comp. 4 | 84 | Absent | −36 | 99.2 | −118 | 254 | 1.088 |
| Comp. 5 | 83 | −50 | Absent | 61.1 | −116 | 288 | 1.055 |
| 1 | 123 | −50 | −17 | 107 | Absent | <130 | 1.000 |
| 2 | 84 | −50 | −25 | 152 | Absent | <130 | 1.000 |
| 3 | 95 | −48 | −22 | 135 | Absent | <130 | 1.000 |

Example 4

The inventive yarn described in Example 2 above was used to construct articles of the invention comprising cross-plied fiber reinforced laminates. Several rolls of the inventive yarn of Example 2 were supplied from a creel and were passed through a combing station to form a unidirectional network. The fiber network was passed over and under stationary bars to spread the yarns into thin layers. The fiber network was then carried under a roll immersed in a bath of a cyclohexane solution of a KRATON® D1107 styrene-isoprene-styrene block copolymer matrix to completely coat each filament.

The coated fiber network was passed through a squeeze roll at the exit of the bath to remove excess sealant dispersion. The coated fiber network was placed on a 0.35 mil (0.00089 cm) polyethylene film carrier web and passed through a heated oven to evaporate the cyclohexane and form a coherent fiber sheet containing 20% wt. % KRATON® matrix. The carrier web and unidirectional fiber sheet were then wound up on a roller in preparation for construction of laminates.

Two different laminates were constructed from the rolls prepared above. A two ply laminate of the invention designated type PCR was formed by placing two rolls of the sheet material described above on the cross-plying machine described in U.S. Pat. No. 5,173,138. The carrier web was stripped off and the two unidirectional fiber sheets were cross-plied 0°/90° and consolidated at a temperature of 115° C. under a pressure of 500 psi (3.5 MPa) to create a laminate.

A four ply laminate of the invention, designated type LCR, consisting of two cross-plied fiber sheets with polyethylene films on the outside surfaces, was similarly prepared. Two rolls of the sheet material described above, including the polyethylene film carrier webs, were placed on the cross-plying machine, cross-plied 0°/90°, fiber-to-fiber, with the polyethylene carrier webs on the outside and then consolidated at a temperature of 115° C. under a pressure of 500 psi (3.5 MPa) to create a laminate.

Composite targets for ballistic testing were constructed from the above laminates. Rigid targets were constructed by stacking and cross-plying several layers of the PCR laminates to the desired areal density and then re-molding at a temperature of 115° C. under a pressure of 500 psi (3.5 MPa). Flexible targets were constructed by cross-plying and loosely stacking several layers of the LCR laminates to the desired areal density.

Ballistic testing of the laminates constructed with the inventive yarn was conducted in comparison with commercially available SPECTRA SHIELD® laminates of the same PCR and LCR types prepared from SPECTRA® 1000 yarn. The ballistic testing was conducted in accord with MIL-STD 662 E.

The results are shown in Table III.

The V50 velocity is that velocity at which the probability that a projectile will penetrate is 50%. SEAC is the specific energy absorption capability of the composite per unit areal density specific to a given projectile. Its units are Joules/g/$m^2$, abbreviated as J-$m^2$/g.

It will be seen that the articles of the invention constructed with the inventive yarn possessed higher V50's and higher SEAC's than the targets prepared with the prior art SPECTRA®1000 yarn over a range of projectiles.

Having thus described the invention in rather full detail, it will be understood that such detail need not be strictly adhered to but that further changes and modifications may suggest themselves to one skilled in the art, all falling within the scope of the invention as defined by the subjoined claims.

TABLE III

Ballistic Test Results

| | Projectile | | | | | | | |
|---|---|---|---|---|---|---|---|---|
| | 17 gr. Frag. Simulator | | 17 gr. Frag. Simulator | | 9 mm FMJ | | 7.62 × 51 mm M80 Ball | |
| Shield Construction | PCR | | LCR | | LCR | | PCR | |
| Fiber | S1000 | Inventive Fiber | S1000 | Inventive Fiber | S1000 | Inventive Fiber | S1000 | Inventive Fiber |
| Areal Density, psf | 1.03 | 1.02 | n.d. | 0.784 | 0.769 | 0.769 | 3.54 | 3.48 |
| V50, ft/sec | 1815 | 1916 | n.d. | 1886 | 1486 | 1607 | 2233 | 2802 |
| V50, meters/sec | 553 | 584 | n.d. | 575 | 453 | 490 | 681 | 854 |
| SEAC, J-m2/g | 30 | 38 | n.d. | 47.5 | 219 | 255 | 128 | 204 |

n.d.—not determined

What is claimed is:

1. A drawn polyethylene multi-filament yarn comprising:

polyethylene having an intrinsic viscosity in decalin at 135° C. of from about 5 dl/g to 45 dl/g, fewer than about two methyl groups per thousand carbon atoms, and less than about 2 wt. % of other constituents; said multi-filament yarn having a tenacity of at least 33 g/d as measured by ASTM D2256-02, and when measured by dynamic mechanical analysis on a Rheometrics Solids Analyzer RSA II in a force proportional mode in tension with the static force held at 110% of dynamic force, the dynamic strain at 0.025±0.005%, the heating rate at 2.7±0.8° C./min and a frequency in the range of from 10 to 100 radians/sec, having an integral strength of the β-dispersion of the loss modulus above a base line drawn through the wings of said β-dispersion at least 90 GPa-° C.

2. The polyethylene multi-filament yarn of claim 1, having in a temperature range of 50° C. to 125° C. and at a frequency of 10 radians/sec, no peak in the loss modulus having a full width at half height at least 10° C.

3. The polyethylene multi-filament yarn of claim 1, wherein the β-dispersion of the loss modulus has two components.

4. An article comprising a drawn polyethylene multi-filament yarn described in claim 1.

5. The article of claim 4, comprising at least one network of said drawn polyethylene multi-filament yarns.

6. The article of claim 5, comprising a plurality of networks of said drawn polyethylene multi-filament yarns, said networks being arranged in unidirectional layers, the direction of the fibers in one layer being at an angle to the direction of fibers in adjacent layers.

* * * * *